United States Patent [19]

Kochemidov et al.

[11] 4,030,249

[45] June 21, 1977

[54] AUTOMATIC MACHINE FOR MAGNETIC ABRASIVE POLISHING OF INTERNAL ROTATIONAL SURFACES

[75] Inventors: Atanas Dimitrov Kochemidov; Boris Georgiev Makedonski; Ivan Minkov Dumanov; Stefan Georgiev Payakov; Peter Konstantinov Galabov; Haralampi Aangelov Atanassov, all of Sofia, Bulgaria

[73] Assignee: Zniitmash, Sofia, Bulgaria

[22] Filed: Oct. 2, 1975

[21] Appl. No.: 618,939

[52] U.S. Cl. ..... 51/105 R

[51] Int. Cl.[2] ..... B23C 3/05

[58] Field of Search ..... 51/105 R, 134

[56] References Cited

UNITED STATES PATENTS

| | | | |
|---|---|---|---|
| 588,441 | 8/1897 | Kann | 51/292 |
| 2,219,425 | 10/1940 | Lott | 51/88 |
| 2,231,556 | 2/1941 | Arpin | 51/88 |
| 2,735,232 | 2/1956 | Simjian | 51/7 |
| 2,848,363 | 11/1974 | Lovness et al. | 51/317 |
| 3,716,946 | 2/1973 | Graf | 51/9 |
| 3,898,769 | 8/1975 | Makedonski et al. | 51/88 |

*Primary Examiner*—James L. Jones, Jr.
*Attorney, Agent, or Firm*—Armstrong, Nikaido & Marmelstein

[57] ABSTRACT

An automatic machine for magnetic abrasive polishing of internal rotational surfaces and especially internal race-ways of anti-friction bearings through a rotating magnetic indicator and ferromagnetic powder including a rotating charging device connected to a rotating table and adapted to follow various working positions, with chucks located on the table for chucking the work pieces and including independent rotation and electromagnetic heads as well as a removing device rotating synchronously with the charging device.

3 Claims, 3 Drawing Figures

AUTOMATIC MACHINE FOR MAGNETIC ABRASIVE POLISHING OF INTERNAL ROTATIONAL SURFACES

The present invention relates to an automatic machine for magnetic abrasive polishing of internal rotational surfaces, especially internal race-ways of antifriction bearings, through a rotating magnetic indicator and ferromagnetic powder similar to automats for polishing external rotational surfaces.

An automatic machine for polishing external rotational surfaces has a rotating charging device kinematically connected to a rotating table and adapted to follow the various working positions. On the table there are located chucks for chucking the workpieces with independent rotation and electromagnetic processing heads. The automatic machine has a removing device rotating synchronically with the charging device. Each electromagnetic head processes two neighbouring workpieces. In the area of removing and charging of the workpieces the electromagnetic heads are moved radially inwards.

The disadvantage of this automatic machine consists in its inability to polish internal surfaces, especially internal race-ways of antifriction bearings.

It is the purpose of this invention to avoid the above disadvantages by creating an automatic machine for magnetic abrasive polishing of internal rotational surfaces, especially internal race-ways. The task is accomplished by means of an automatic machine with rotating electromagnetic inductors with a working tip inside the workpiece, and in the area of the removing and charging devices the electromagnetic heads are adapted to rotate around a horizontal axis touching pull rods with one cam.

The automatic machine consists of an analogical round casing with a rotating table seated in it. An electric motor connected through an external and internal reducing gear with a gearwheel to drive the rotating table on which a series electromagnetic selfdriving heads are placed. Each of the electromagnetic heads terminates with a working disk, the dimensions and profile of which conform to the working race-ways. Along the periphery of the rotating table and below the drives of the working positions are located their ends with membrane chucks for chucking the workpieces placed on the table.

The number of working positions equals the number of electromagnetic heads. On the other reductor a removing and charging device is mounted, synchronized with the rotation of the reductor.

The workpieces come though an inclined shute in predetermined intervals, separated from each other by means of a cut-off plate. In the area of the removing and charging device, two immovable cams are mounted. One of them operates with pull rods for vertical rotation of the electromagnetic heads and the second operates through a laver system to free the detail from the membrane chuck.

To each electromagnetic head, a hose is attached as well as a cock for supplying cutting fluid.

The electromagnetic heads consist of a coil embracing a rotating core. The rotation is performed by means of an electric motor and a worm reductor. The whole system is mounted on a casing attached to a vertical plate by means of dovetails. Thus, the head can be vertically adjusted. The vertical plate has two side parts carrying the bearings of a horizontal axis. Around this axis the whole electromagnetic head can rotate when pulled by one rod. The reverse move is performed by means of a spring.

Under operating conditions the charging device supplies a workpiece to the membrane chuck which chucks it automatically. The respective electromagnetic head turns and its tip enters into the race-way to be polished. After the table has performed almost one revolution this working position moves to the removing device which takes off the ready detail and delivers it to a respective shute. Throughout the process of work, cutting fluid is supplied continuously. After chucking the next workpiece a predetermined batcher supplies a portion of ferromagnetic powder.

An embodiment of the automatic machine for magnetic abrasive polishing of internal rotational surfaces, especially internal race-ways of antifriction bearings, according to the invention is shown in the accompaning drawings, which illustrate the the device in detail, as well as its operation:

Figure 1:
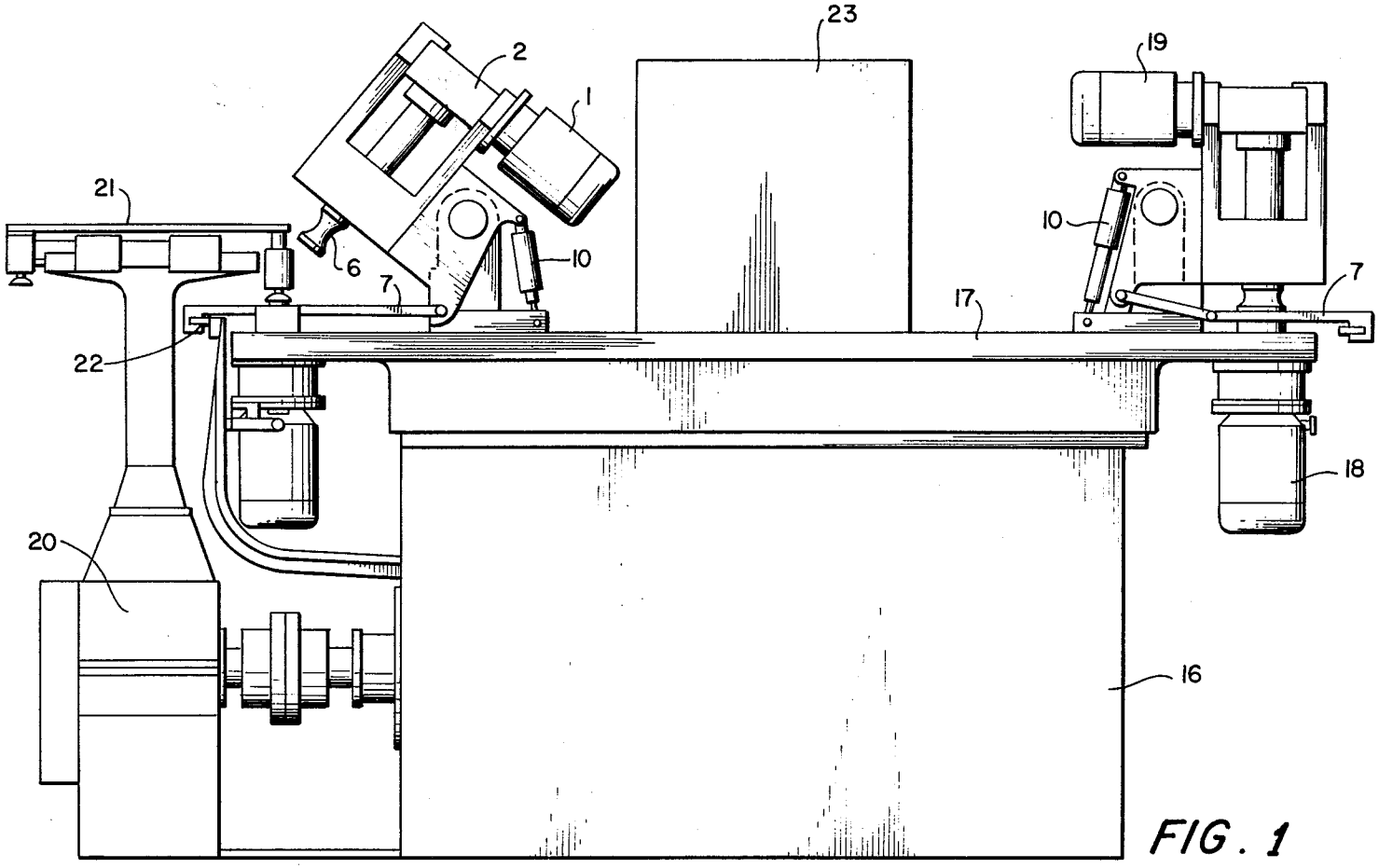
FIG. 1 is a general side view of the automatic machine
Figure 2:
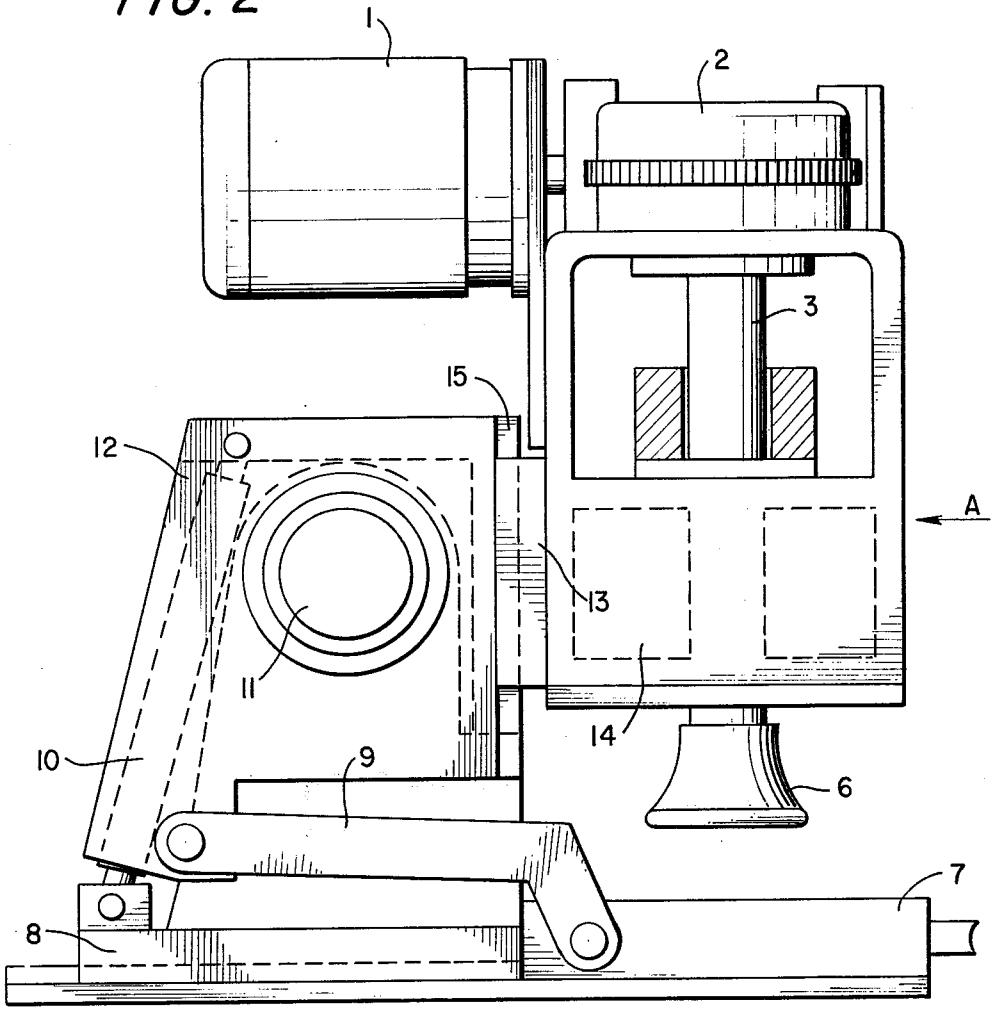
FIG. 2 is a side view of the electromagnetic head

The casing 16 bears a rotating table 17 on which a number of working positions are placed, each of them consisting of a membrane chuck for chucking the workpiece, which chuck is self-driven by electric motor 18. Above the working positions, electromagnetic heads 19 are placed, also selfdriven. The table 17 is brought into rotation by an external electric motor through reductor 20. In FIG. 1 device 21 for removing the workpieces is also shown. The immovable cam 22 by contacting the rollers of pull rods 7, turns the electromagnetic heads around horizontal axis 11 shown in FIG. 2. In the middle of rotating table 17, a standard device 23 for supplying power is placed.

Figure 3:
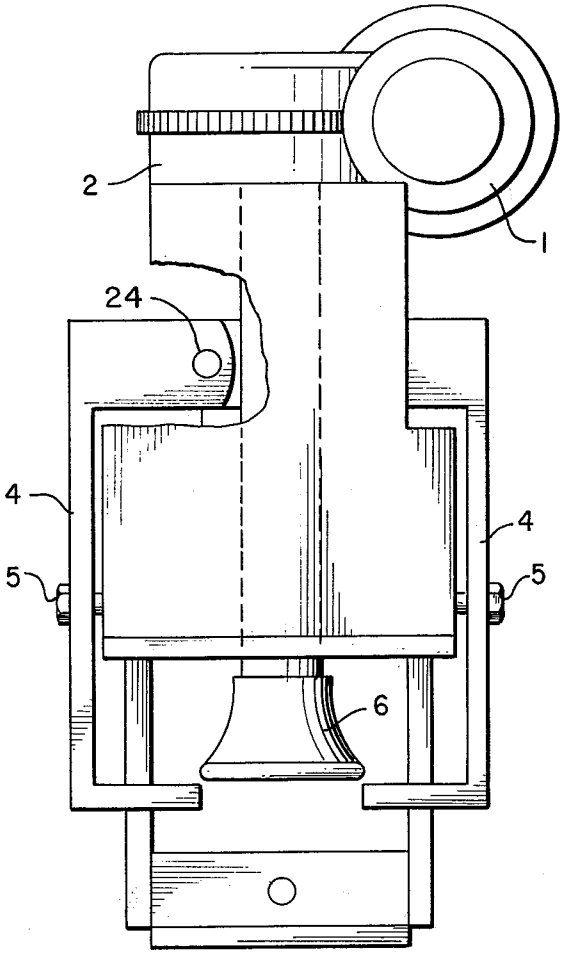
FIG. 3 is a view in direction A from FIG. 2.

Electromagnetic heads 19 (FIG. 1, FIG. 2 and FIG. 3) consist of a bracket 15 which bears frame 12 through the horizontal axis 11. An electric motor 1 drives worm reducer 2 which brings into motion rotating core 3. Towards the end of rotating core 3 a changeable magnetic tip 6 is mounted. Rotating core 3 passes through electromagnetic coil 14.

The plate with dove tails 13 allows adjusting vertical displacement of electromagnetic head 19. Electromagnetic head 19 rotates around horizontal axis 11 under the influence of pull rods 7 and hinged lever 9 and is dampened by compensating spring 10. Electromagnetic head 19 can move horizontally along guides 8. The operation of hinged lever 9 on pull rods 7 is performed by immovable cam 22. Hinged lever 9 compensates for the difference between the rectilinear motion of guides 8 and the motion of frame 12.

Rotating core 3 is embraced also by a closed magnetic curcuit which consists of two jaws 4 hinged to an immovable bushing through which rotating core 3 passes by means of bolt 24, which jaws can be adjusted by means of bolts 5 and serve to close the magnetic circuit through the workpiece and magnetic tip 6.

If magnetic tip 6 is properly profiled, various types of groove surfaces can be polished. The magnetic tips 6 are easily changeable which makes it possible to polish rings of different diameters.

The charging and removing device, the casing 16, the table 17, the positions for chucking and rotating the workpieces and all other additional systems and devices are completely analogical to those of the automatic machine for magnetic abrasive polishing of ring-shaped parts.

What we claim is:

1. An automatic machine for magnetic abrasive polishing of internal rotation surfaces, especially internal race-ways of antifriction bearings, by means of an electromagnetic inductor and ferromagnetic powder, comprising a rotating table mounted on a casing with a plurality of working positions having means for receiving and chucking workpieces wherein on each working position there is an electromagnetic head means with a rotating magnetic tip adapted to be introduced into a workpiece received by a position without touching the processed surface, and wherein the electromagnetic heads are vertically rotated around a horizontal axis.

2. An automatic machine according to claim 1, wherein an immovable cam means contacts a pull rod connected to a hinged lever, for pulling a frame with a bracket, and said frame is located adjacent to said electromagnetic head and in operative connection therewith.

3. An automatic machine according to claim 2, wherein a rotating core has a closed magnetic circuit in the form of two jaw members hinged to an immovable bushing means through which the rotating core adjustably passes by means of a bolt, wherein said jaws surround said core and connectively extend from said frame.

* * * * *